US007583228B2

(12) United States Patent
Tsai et al.

(10) Patent No.: US 7,583,228 B2
(45) Date of Patent: Sep. 1, 2009

(54) ANTENNA, ANTENNA COMBINATION, AND PORTABLE ELECTRONIC DEVICE HAVING THE ANTENNA OR ANTENNA COMBINATION

(75) Inventors: Feng-Chi Eddie Tsai, Taipei Hsien (TW); Yu-Chuan Su, Taipei Hsien (TW); Yuan-Li Chang, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 15 days.

(21) Appl. No.: 12/076,466

(22) Filed: Mar. 19, 2008

(65) Prior Publication Data

US 2009/0015504 A1 Jan. 15, 2009

Related U.S. Application Data

(63) Continuation-in-part of application No. 11/826,240, filed on Jul. 13, 2007.

(30) Foreign Application Priority Data

Sep. 21, 2007 (TW) ..... 96135530

(51) Int. Cl.
*H01Q 1/24* (2006.01)

(52) U.S. Cl. ..... 343/702; 343/700 MS

(58) Field of Classification Search ..... 343/702, 343/700 MS, 846

See application file for complete search history.

(56) References Cited

U.S. PATENT DOCUMENTS 6,812,892 B2 * 11/2004 Tai et al. ..... 343/700 MS
6,861,986 B2 * 3/2005 Fang et al. ..... 343/700 MS
7,439,911 B2 * 10/2008 Wang ..... 343/700 MS

* cited by examiner

*Primary Examiner*—Hoang V Nguyen
(74) *Attorney, Agent, or Firm*—Bacon & Thomas, PLLC

(57) ABSTRACT

Antenna, antenna combination, and portable electronic device having the antenna or the antenna combination are disclosed. The antenna comprises a radiator, a grounding portion, and an arc-shaped feeding portion connected with a coaxial cable for feeding electronically. A first end of the arc-shaped feeding portion is connected with the radiator, and a second end of the arc-shaped feeding portion is connected with the grounding portion.

20 Claims, 15 Drawing Sheets

ANTENNA, ANTENNA COMBINATION, AND PORTABLE ELECTRONIC DEVICE HAVING THE ANTENNA OR ANTENNA COMBINATION

CROSS-REFERENCE

This application is a continuation-in-part (CIP) of application Ser. No. 11/826,240, filed on Jul. 13, 2007. The prior application is herewith incorporated by reference in its entirety.

BACKGROUND OF THE INVENTION

1. Field of the Invention

The present invention relates to an antenna and a portable electronic device having the same.

2. Description of the Related Art

With the evolution of wireless communication technology, various portable devices are exploiting wireless communication technology for data transmission, thus causing the antenna design to evolve at a rapid rate. Nowadays, these portable communication devices are becoming lighter and smaller, and the antenna must also be reduced in size in order to be installed into these electronic devices.

In terms of antenna's exterior design, the lengthy external antenna that is designed to receive and transmit radio frequency has become shorter and has been internalized, and it makes the appearance of the devices more appealing. In terms of application aspect, antenna is able to take on different shapes and sizes, thus the antennas can be designed accordingly to comply with various electronic appliance standards and to cater for different system products. Therefore, antenna manufacturing has the characteristic of high versatility with low volume. However, the basic objective of designing an antenna is to improve the quality of signal transmission and reception, thus this property should not be compromised from improving its exterior appearance, size or choice of material.

Nowadays, the helical antenna and the monopole antenna are used in the circuit separately, and its pitfall is that both the helical antenna and the monopole antenna can only have a single-band frequency respectively. The applicant of the present invention has filed a U.S. patent application with application Ser. No. 11/806,287 on Can 31, 2007, which discloses a multi-frequency antenna combining with helix element and/or radiating element. The multi-frequency antenna comprises a helix element connecting to a feeding portion and a helix element connecting to a grounding portion. The radiating element is resonated with high frequency such as 5 GHz, and the helix element is resonated with low frequency such as 2.4 GHz. However, the multi-frequency antenna of the U.S. application Ser. No. 11/806,287 further comprises a base for fixing the radiating element and the helix element, and further for grounding and feeding capabilities.

SUMMARY OF THE INVENTION

The present provides an antenna, an antenna combination, and a portable electronic device having the antenna or the antenna combination.

It is an object of the present invention to provide an antenna, an antenna combination, and a portable electronic device having the antenna or the antenna combination for which the manufacturing process can be simplified.

It is another object of the present invention to provide an antenna, an antenna combination, and a portable electronic device having the antenna or the antenna combination for which the manufacturing cost can be reduced.

It is a further object of the present invention to provide an antenna, an antenna combination, and a portable electronic device having the antenna or the antenna combination for which a similar level of performance as that of the Planar Inverted F Antenna (PIFA) can be can achieved.

The antenna receives or transmits wireless signals by using a coaxial cable to feed current. The antenna comprises a radiator; a grounding portion; and an arc-shaped feeding portion coupled with the coaxial cable for feeding current, wherein a first end of the arc-shaped feeding portion is connected with the radiator, and a second end of the arc-shaped feeding portion is connected with the grounding portion.

The grounding portion of the antenna can comprise a helix structure.

In one embodiment, the antenna can further comprise a fixing portion extending from the grounding portion, the fixing portion can be shaped in circular, round, or polyhedron.

In another embodiment, the radiator of the antenna comprises a plurality of bending portions, for example, the radiator can have at least one U-shaped portion formed by the plurality of bending portions, in response to different requirements for high frequency resonance.

Furthermore, the present invention provides an antenna combination, which comprises a coaxial cable, a grounding element and the antenna depicted above. The coaxial cable is connected with the arc-shaped feeding portion of the antenna to feed current into the antenna. The grounding element covers at least one portion of the grounding portion of the antenna.

Still further, the coaxial cable comprises a feeding core, an isolating layer, a meshed metal layer, and an insulating sleeve. The isolating layer covers the feeding core and exposes a portion of the feeding core. The meshed metal layer covers the isolating layer and exposes a portion of the isolating layer. The insulating sleeve covers the meshed metal layer and exposes a portion of the meshed metal layer.

The arc-shaped feeding portion of the antenna is connected with the feeding core, wherein the arc-shaped feeding portion can be shaped in circular in order to facilitate the process of connecting the feeding core with the arc-shaped feeding portion when manufacturing. Preferably, the grounding portion can be shaped in helical to cover the meshed metal layer of the coaxial cable therein. The helical grounding portion can have more contact areas with the meshed metal layer and be fixed with the meshed metal layer, however, the grounding portion of the present invention is not limited to helical shape, on the other hand, the grounding portion can have different shapes as long as it can contact with the meshed metal layer of the coaxial cable.

The grounding portion and the meshed metal layer can be fixed with each other, for example through soldering. The arc-shaped feeding portion and the feeding core can be fixed with each other through soldering as well.

In order to fix the antenna to other application devices, the fixing portion of the antenna can use a fixing means (such as screwing or soldering) to fix the antenna to a case of other application device. The fixing portion can be in any shape, for example, the fixing portion can be round, square, triangular, or polyhedron.

Moreover, the antenna disclosed in the present invention further comprises a fixed connection portion extending from the grounding portion so as to meet different requirements by connecting the antenna with another antenna.

Besides, the above-mentioned antenna or antenna combination can be applied in portable electronic devices. Therefore, the present invention discloses a portable electronic device, which can be a laptop, a personal digital assistant (PDA), or a mobile phone capable of transmitting/receiving wireless signals. The portable electronic device disclosed in the present invention comprises a case, a wireless communication module, and the above-mentioned antenna combination, a coaxial cable of the antenna combination is connected with the wireless communication module for transmitting/receiving wireless signals, and the antenna combination is disposed within the case; for example, the antenna combination is fixed to the case through the fixing portion of the antenna.

Various frequencies can be generated through the antenna disclosed in the present invention to cover a wide range of bandwidths for different system requirements. The antenna of the present invention has high practical industrial value as it is simple to design and all the components are formed in one single process, therefore it also leads to low manufacturing cost.

Figure 1:
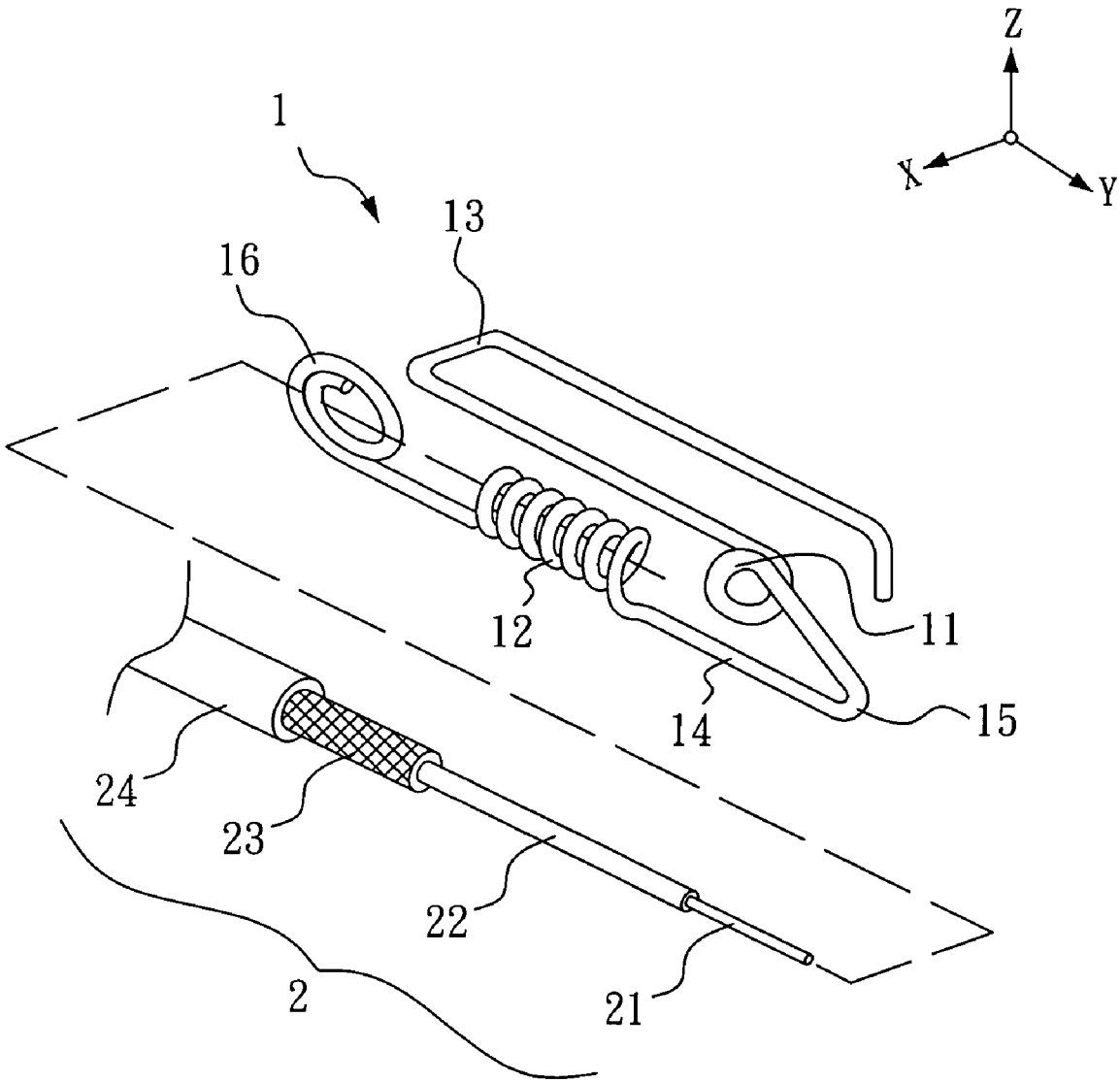
FIG. 1 is a perspective diagram showing an antenna according to one of the embodiments of the present invention.

REFERENCE NUMERALS antenna 1, 5, 10*a*, 10*b*, 10*c*, 11*a*, 11*b*, 11*c*, 11*d*, 120, 12*a*, 12*b*, 12*c*
arc-shaped feeding portion 11, 51
grounding portion 12, 52, 112*a*, 112*b*, 112*c*, 112*d*
radiator 13, 53*a*, 53*b* ground portion 14, 54
connecting portion 15, 55
fixing portion 16, 56, 106*a*, 106*b*, 106*c*
fixed connection portion 121, 122, 123, 124
coaxial cable 2 feeding core 21
isolating layer 22 meshed metal layer 23
insulating sleeve 24 grounding element 3
covering portion 31, 32
case 100 wireless communication module 131
fixing means 99 portable electronic device 140

DETAILED DESCRIPTION OF THE PREFERRED EMBODIMENT

The present invention provides an antenna, an antenna combination, and a portable electronic device having the same. The advantages and innovative features of the invention will become more apparent from the following detailed description when taken in conjunction with the accompanying drawings.

Please refer to FIG. 1, which shows the antenna according to one of the embodiments of the present invention. The antenna 1 uses a coaxial cable 2 to feed current for receiving or transmitting wireless signals.

The antenna 1 disclosed in the present invention comprises an arc-shaped feeding portion 11, a grounding portion 12, and a radiator 13. The arc-shaped feeding portion 11 is connected with the coaxial cable 2 for feeding current thereto. A first end of the arc-shaped feeding portion 11 is connected with the radiator 13, and a second end of the arc-shaped feeding portion 11 is connected with the grounding portion 12.

The radiator 13 of the antenna 1 can comprise a plurality of bending portions for adjusting the high frequency resonance of the antenna 1; that is, changing the current distribution by using the plurality of bending portions to meet different requirements of different frequency resonances. For example, the bending portion of the radiator 13 can be shaped in U shape as illustrated. Based on different requirements, the present invention can use a plurality of bending portions to form a plurality of U shapes for different high frequency resonance conditions, details will be described below.

The arc-shaped feeding portion 11 of the antenna 1 is disposed between the radiator 13 and the grounding portion 12. The grounding portion 12 contacts a portion of the coaxial cable 2, which will be described in detail later.

In one embodiment, the antenna 1 can further comprise a fixing portion 16 extending from the grounding portion 12. The fixing portion 16 can have different shapes, such as circular, round, or polyhedron, etc.

The grounding portion 12 of the antenna 1 can have a helical structure, which will be described in detail later.

Figure 2:
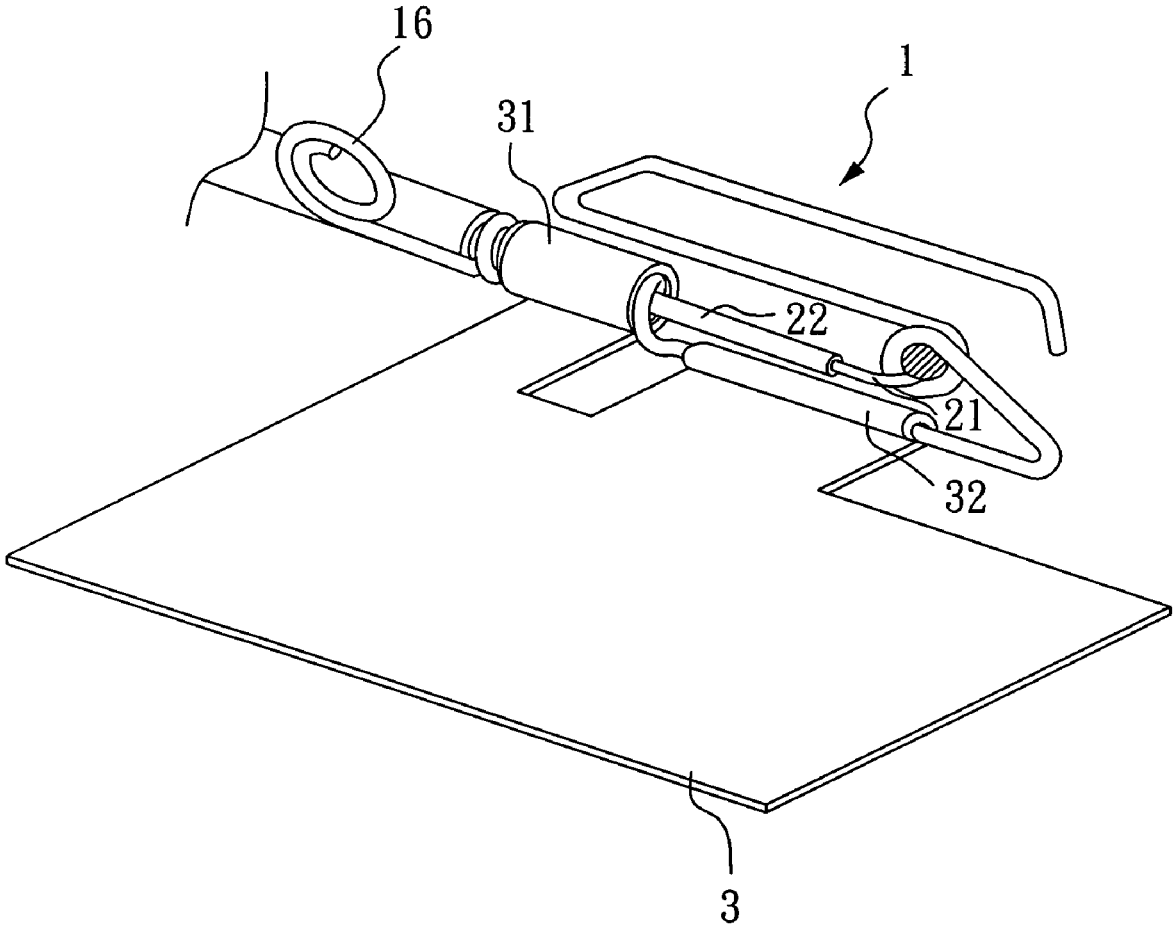
FIG. 2 is a perspective diagram showing the antenna with a grounding element according to the embodiment of FIG. 1.

Besides, please refer to FIG. 1 and FIG. 2, one aspect of the present invention is to provide an antenna combination, which comprises a coaxial cable 2, a grounding element 3, and an antenna (such as the antenna 1 mentioned above).

The coaxial cable 2 can comprise a feeding core 21, an isolating layer 22, a meshed metal layer 23 and an insulating sleeve 24. Stripping by layers, the isolating layer 22 covers the feeding core 21 and exposes a portion of the feeding core 21 as illustrated; the meshed metal layer 23 covers the isolating layer 22 and exposes a portion of the isolating layer 22; and the insulating sleeve covers the meshed metal layer 23 and exposes a portion of the meshed metal layer 23.

In one embodiment, the arc-shaped feeding portion 11 of the antenna 1 is connected with the feeding core 21 of the cable 2, the arc-shaped feeding portion 11 can be shaped in circular in order to facilitate the process of connecting the feeding core 21 with the arc-shaped feeding portion 11 when manufacturing. For example, the arc-shaped feeding portion 11 and the feeding core 21 can be fixed with each other by soldering.

Preferably, the grounding portion 12 can be shaped in helical to cover the meshed metal layer 23 of the coaxial cable 2 therein. The helical grounding portion 12 can have more contact areas with the meshed metal layer 23 and be fixed with the meshed metal layer 23. However, the grounding portion 12 of the present invention is not limited to the helical shape, on the other hand, the grounding portion 12 can have different shapes. The grounding portion 12 and the meshed metal layer 23 can be further fixed with each other by soldering.

The antenna 1 can further comprise a second grounding portion 14 disposed between the arc-shaped feeding portion 11 and the first grounding portion 12. A connecting portion 15 can be further provided between the second grounding portion 14 and the arc-shaped feeding portion 11, the shape of the connecting portion 15 can be varied based on different design requirements.

The antenna 1 and the coaxial cable 2 of the present invention can be grounded through the covering portion 31, 32 of the grounding element 3 covering the grounding portion 12 and the grounding portion 14 respectively.

In order to fix the antenna 1 to other application devices (which will be explained below), a fixing portion 16 of the antenna 1 can be adapted to screw or solder the antenna 1 to other application devices. The fixing portion 16 can be in any shape, such as round, square, triangular, polyhedron, or the like.

Figure 3:
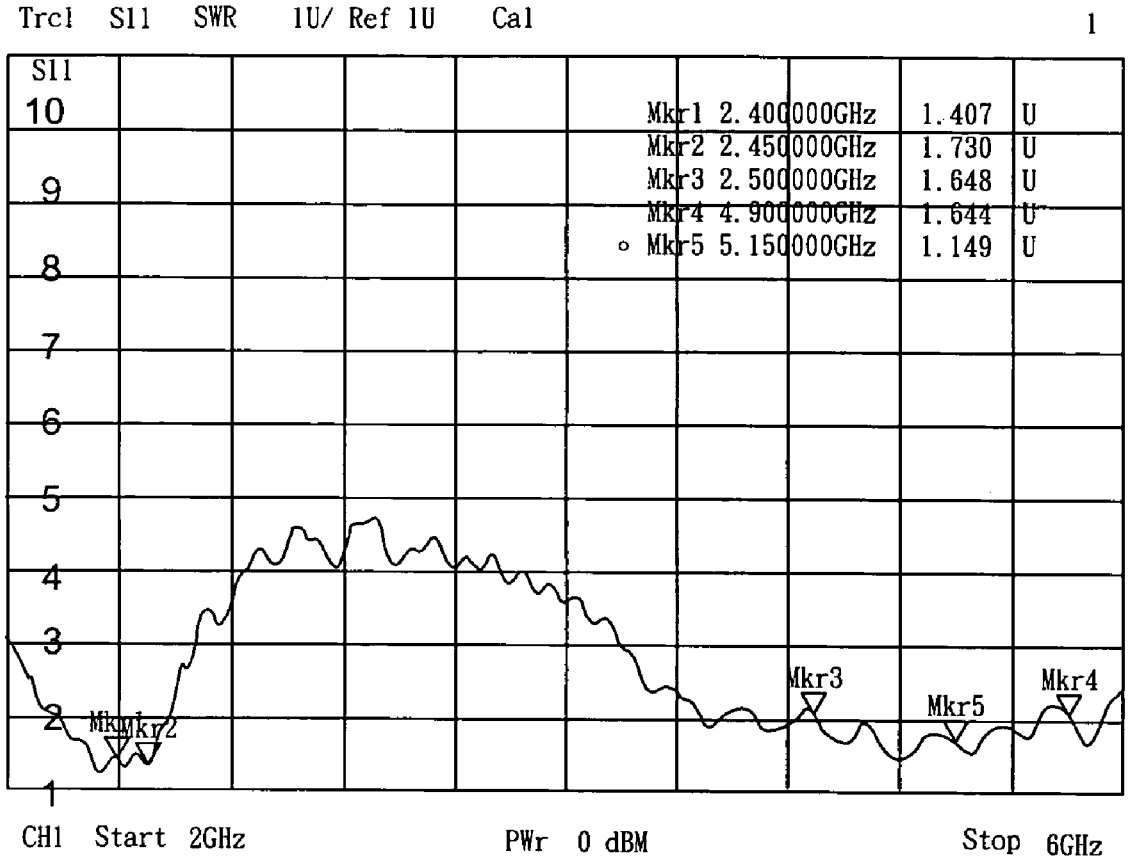
FIG. 3 is a Voltage Standing Wave Ratio (VSWR) diagram according to the embodiment of FIG. 2.
Figure 4:
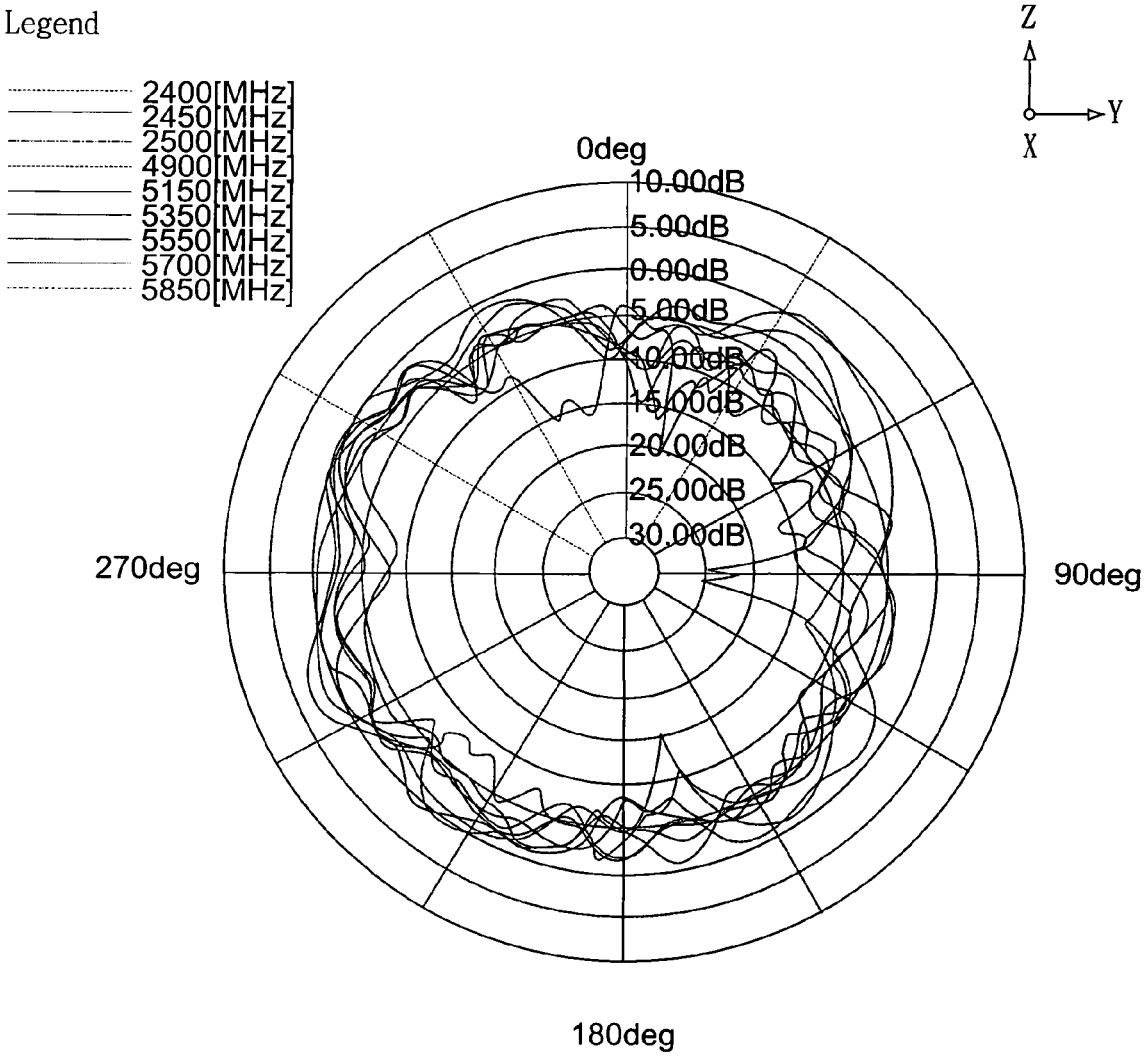
FIG. 4 shows a radiation pattern with Y-Z plane according to the embodiment of FIG. 2.

FIG. 3 is a Voltage Standing Wave Ratio (VSWR) diagram according to the embodiment of FIG. 2. It is obvious that the VSWR ratio of the antenna 1 of the present invention under both high and low frequencies (such as 2 GHz and 5 GHz) are smaller or equal to 2, which are better than the standard VSWR ratio of 2.5 commonly known in the industry. Further refer to FIG. 4, which shows a radiation pattern with Y-Z plane according to the embodiment of FIG. 2. From FIG. 4, it can be seen that the antenna 1 of the present invention has a uniform radiation pattern.

Figure 5:
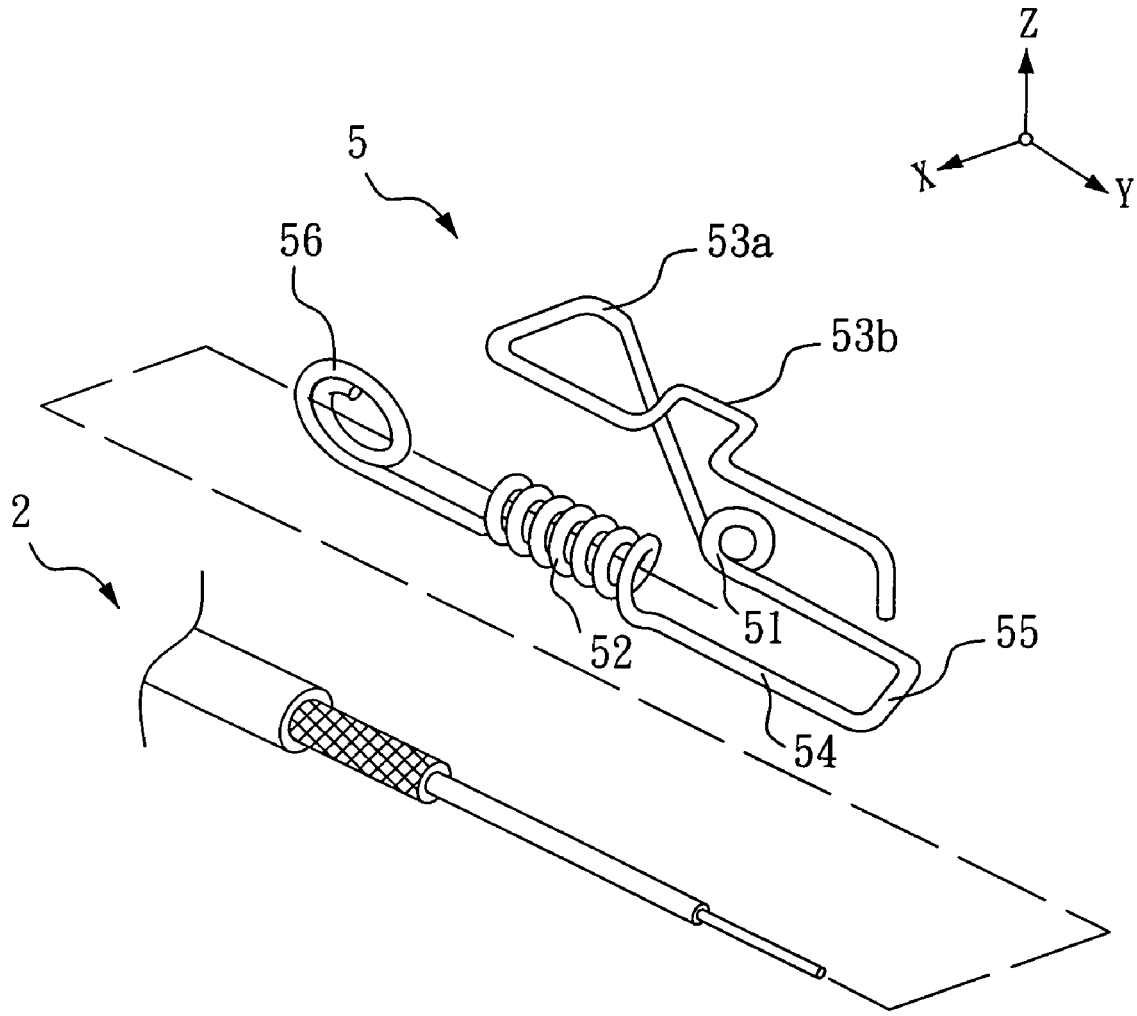
FIG. 5 is a perspective diagram showing an antenna according to another embodiment of the present invention.

Please refer to FIG. 5, which is a perspective diagram showing an antenna according to another embodiment of the present invention. In this embodiment, an antenna 5 comprises a radiator having a plurality of bending portion 53*a*, 53*b* for forming a plurality of U shapes. Further, the bending portion 53*a* shown in FIG. 5 is bended in three dimensions. Moreover, although the bending portion 53*b* is disposed in the X-Y plane, the bending portion 53*b* can be disposed in the X-Z or z-y plane (not shown in figures) based on different high frequency resonance requirements.

The connecting portion 15 shown in FIG. 1 is bended in three dimensions, however, based on different designs, in the embodiment illustrated in FIG. 5, the connecting portion 55 can be in a U shape. Although different connecting portion 15, 55 are shown in FIG. 1 and FIG. 5, they are only for illustration and not used to limit the present invention, the number and the shape of the connecting portion 15, 55 can be different in various embodiments.

Figure 6:
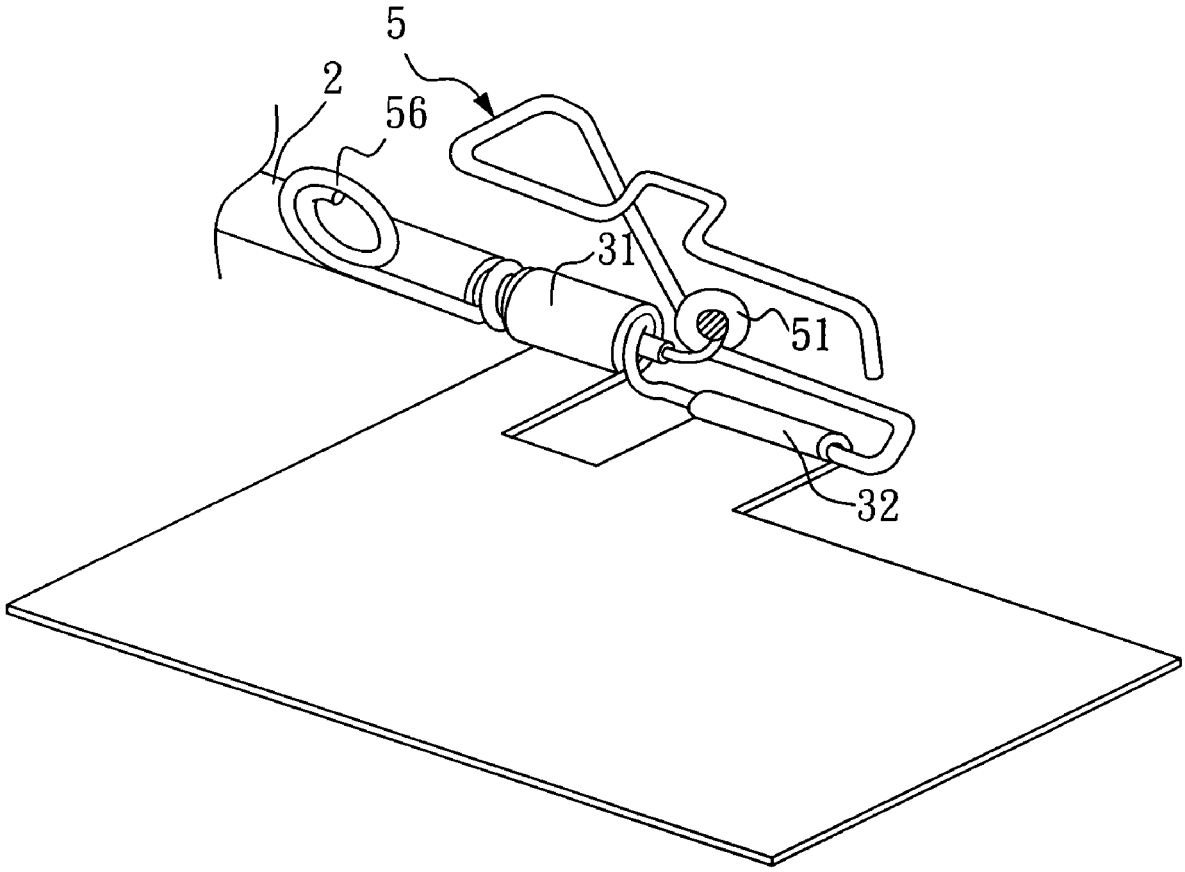
FIG. 6 is a perspective diagram showing the antenna in the embodiment of FIG. 5 with a grounding element.
Figure 7:
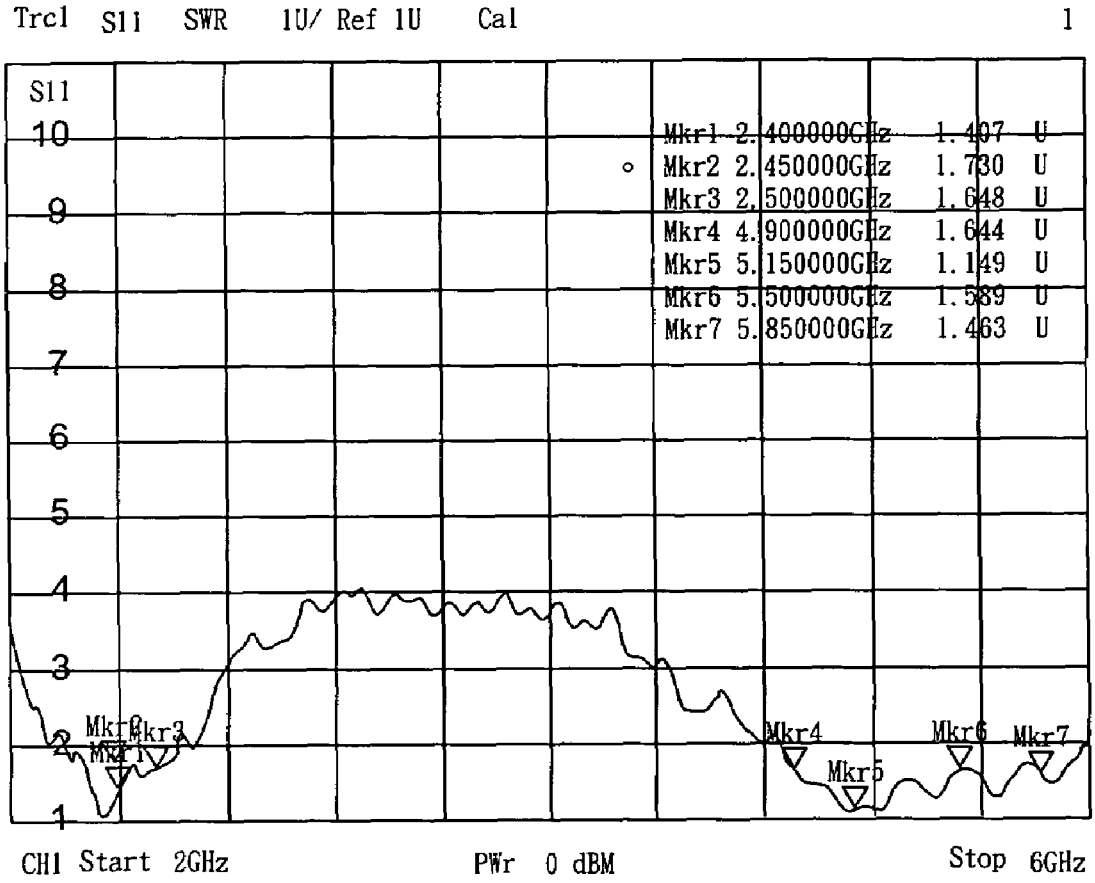
FIG. 7 is a Voltage Standing Wave Ratio (VSWR) diagram according to the embodiment of FIG. 6.
Figure 8:
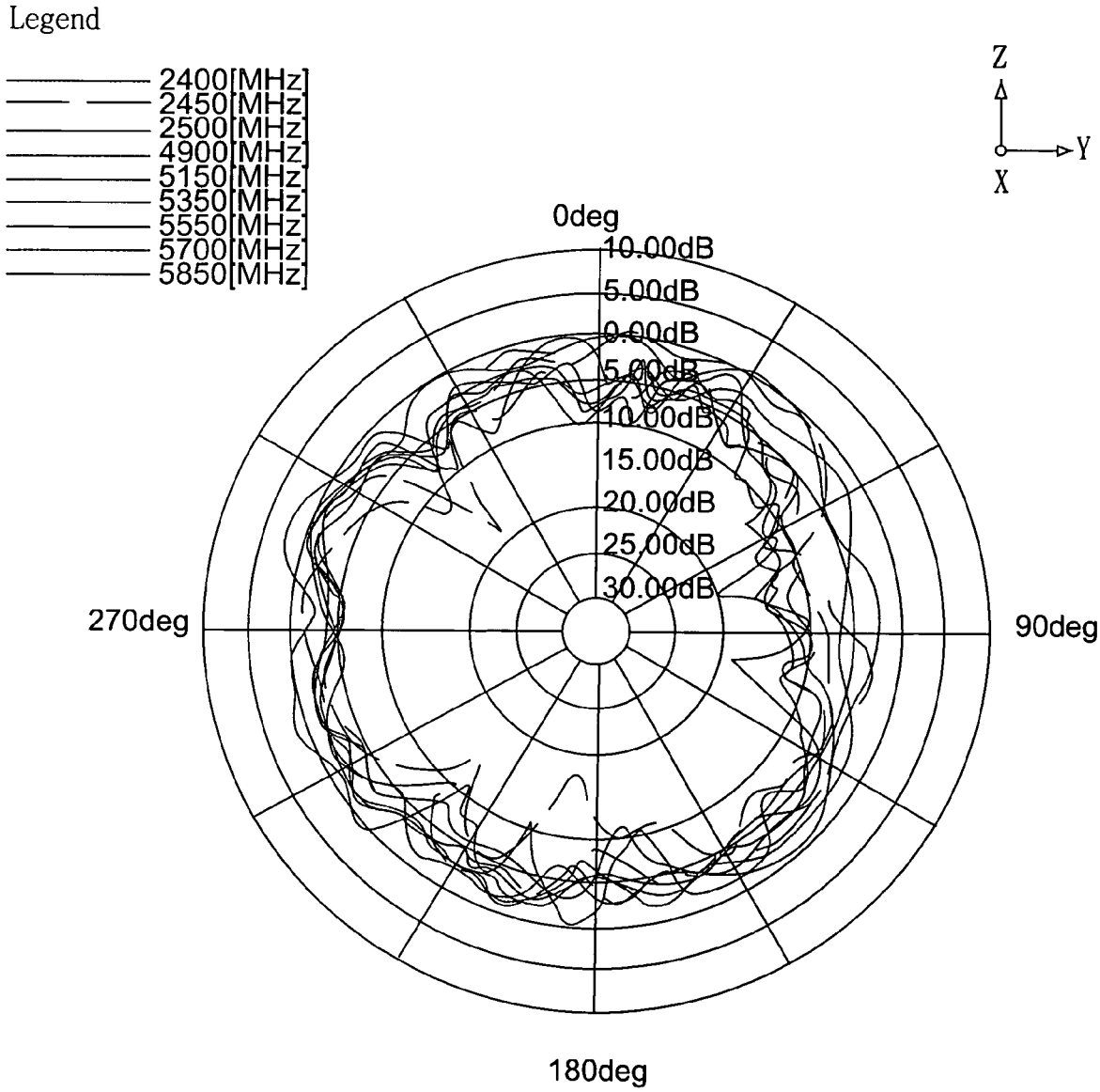
FIG. 8 shows a radiation pattern with Y-Z plane according to the embodiment of FIG. 6.

Similarly, FIG. 6 is a perspective diagram showing an antenna combination comprising the antenna 5 in FIG. 5 with the coaxial cable 2 and the grounding element 3. FIG. 7 is a Voltage Standing Wave Ratio (VSWR) diagram according to the embodiment of FIG. 6. It is obvious that the VSWR ratio of the antenna 5 in the present invention under both high and low frequencies (such as 2 GHz and 5 GHz) are far less than 2, which are much better than the standard VSWR ratio of 2.5 commonly known in the industry. Further referring to FIG. 8, which shows a radiation pattern with Y-Z plane, from FIG. 4, it can be seen that the antenna 5 of the present invention has a relative uniform radiation pattern.

Figure 9:
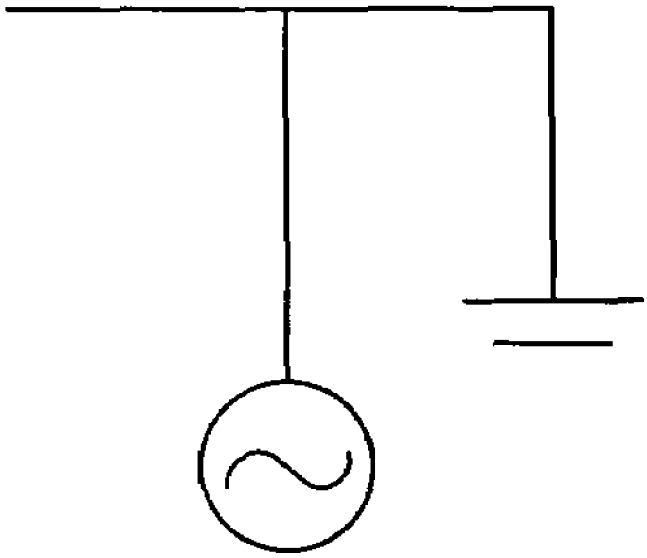
FIG. 9 is an equivalent circuit diagram according to the antenna disclosed in the present invention.

FIG. 9 is an equivalent circuit diagram for the antenna 1, 5 disclosed in the present invention. By designing the radiator 13, 53*a*, or 53*b* to have various shapes, the antenna 1 or 5 can have smaller size and also maintain a certain performance. Those skilled in the art should know the length of the antenna 1 or 5 is designed based on ¼ wavelength of the transmitted wave, therefore it will not be necessary for further describing.

Figure 10A:
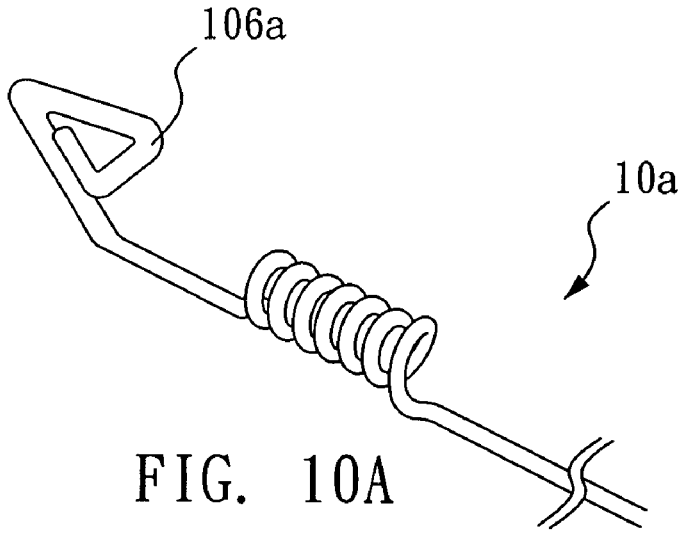
FIG. 10A to FIG. 10C show different variations of the fixing portion according to the antenna disclosed in the present invention.
Figure 10B:
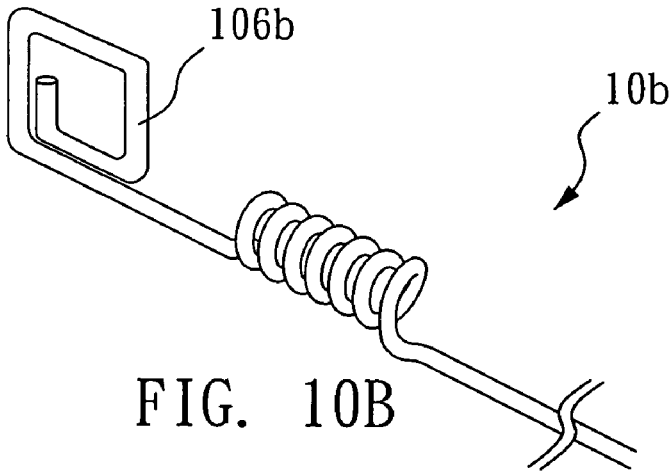
Figure 10C:
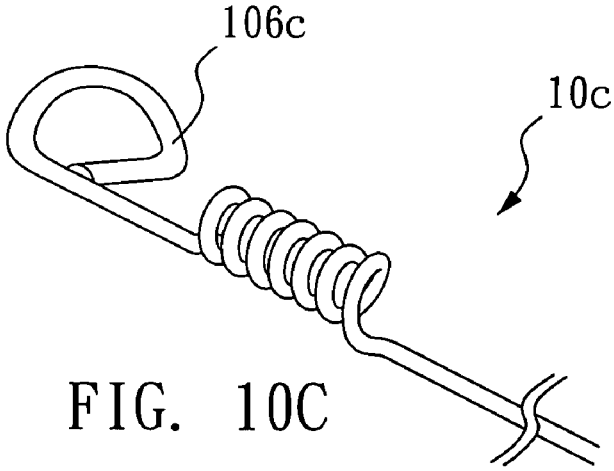
Figure 11A:
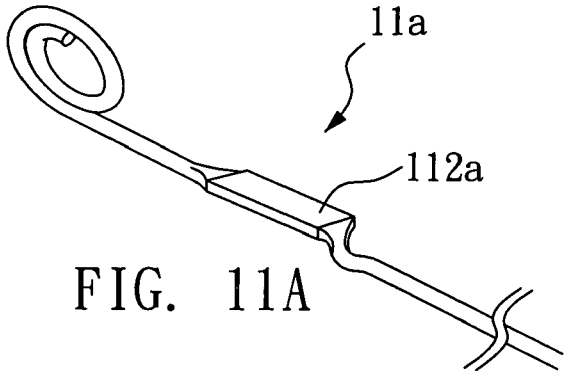
FIG. 11A to FIG. 11D show different variations of the first grounding portion according to the antenna disclosed in the present invention.
Figure 11B:
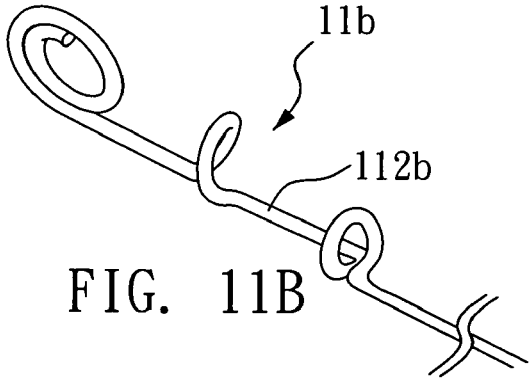
Figure 11C:
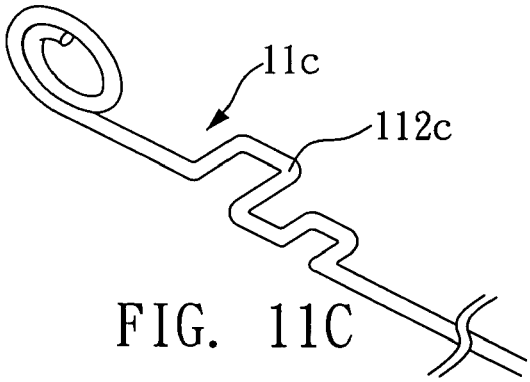
Figure 11D:
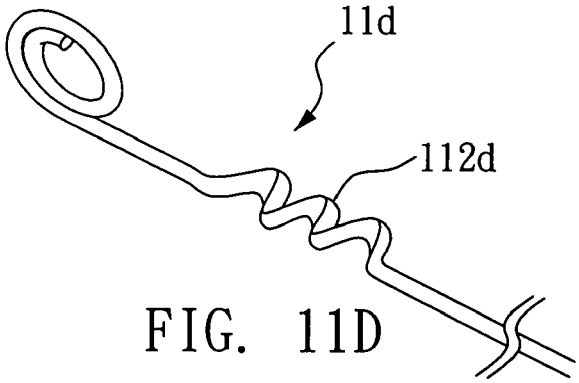

Still further, although the fixing portion 16, 56 shown respectively in FIG. 1 and FIG. 5 are shaped in circular for fitting the screw, the present invention can have other variations. The fixing portion can be shaped differently for fixing the antenna to application devices. Please refer to FIG. 10A to 10C, which show various antennas 10*a*, 10*b*, 10*c* respectively comprising fixing portion 106*a*, 106*b*, 106*c* being in different shapes.

As mentioned above, in order to simplify the manufacturing process, the grounding portion 12 illustrated in FIG. 1 is employed to cover the meshed metal layer 23 of the coaxial cable 2, however, the present invention is not limited to the helical grounding portion 12. Please refer to FIG. 11A to 11D, the grounding portion 112*a* to 112*d* of the antennas 11*a* to 11*d* can have different shapes to contact with the meshed metal layer 23 of the coaxial cable 2.

Figure 12:
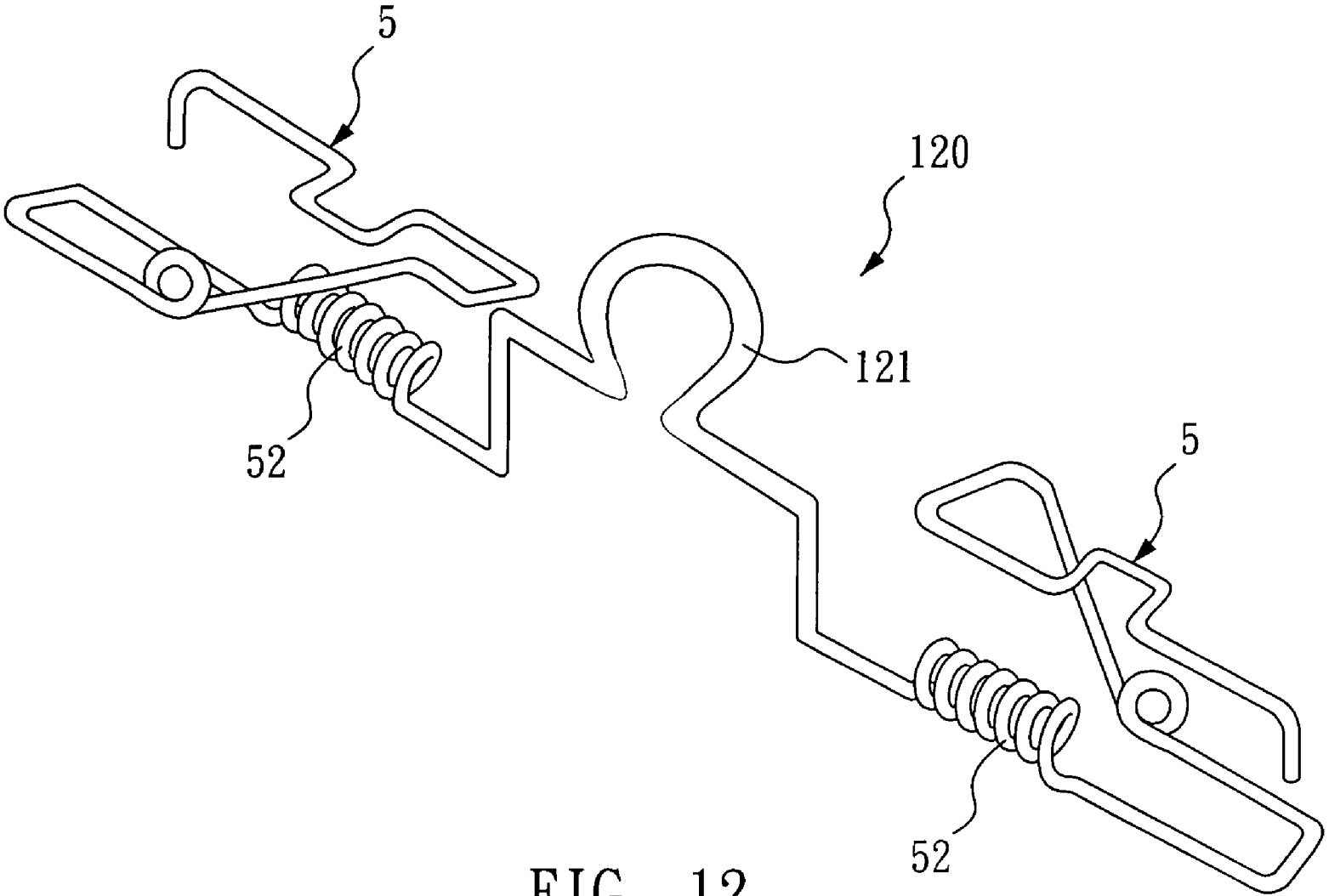
FIG. 12 shows two antennas of the present invention being connected with each other through a fixed connection portion.
Figure 12A:
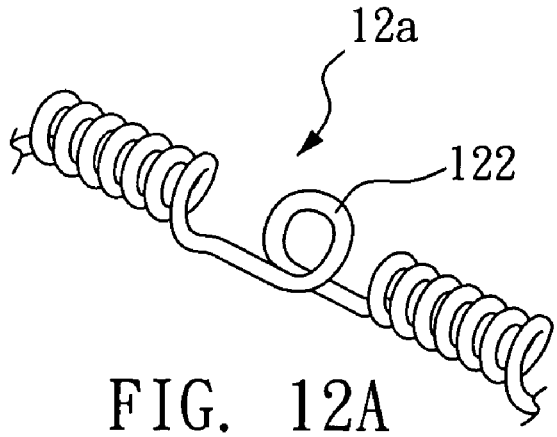
FIG. 12A to FIG. 12C show different variations of the fixed connection portion of FIG. 12 according to the antenna disclosed in the present invention.
Figure 12B:
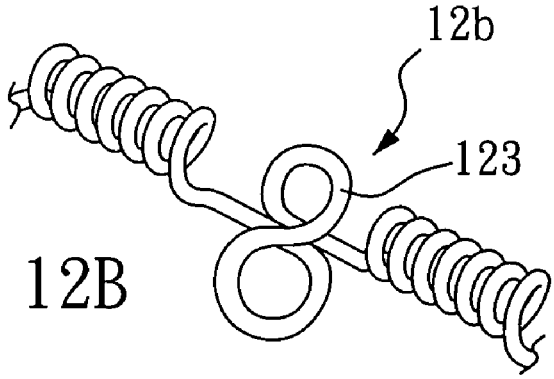
Figure 12C:
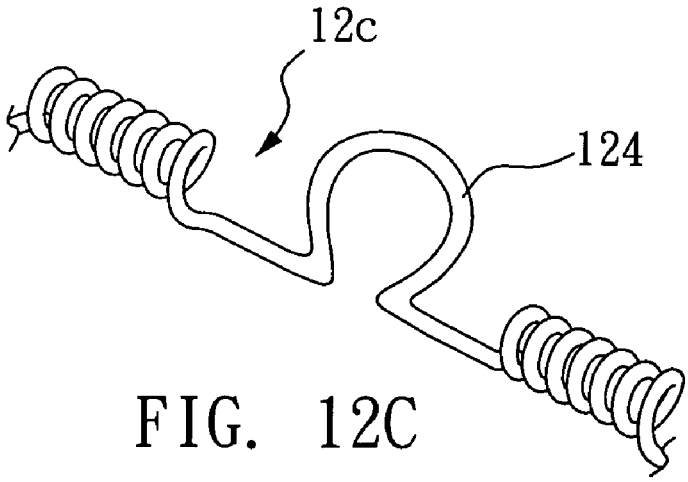

Please refer to the embodiment of FIG. 12. In order to provide different functions for different applications, the antenna 5 disclosed in the present invention can further comprise a fixed connection portion 121 extending from the grounding portion 52. The fixed connection portion 121 is disposed to connect with another antenna 5 to achieve required functions. Although, in FIG. 12, we take the antenna 5 as the example, it is only for illustration and not for limitation. Other antennas 1, 10*a*-10*c* or 11*a*-11*d* can be utilized for FIG. 12. Besides, as shown in FIG. 12A to 12C, the fixed connection portion 122, 123, 124 can be shaped differently.

Besides, all of the antennas provided in the present invention can be applied in various portable electronic devices. Another aspect of the present invention discloses a portable electronic device.

Figure 13:
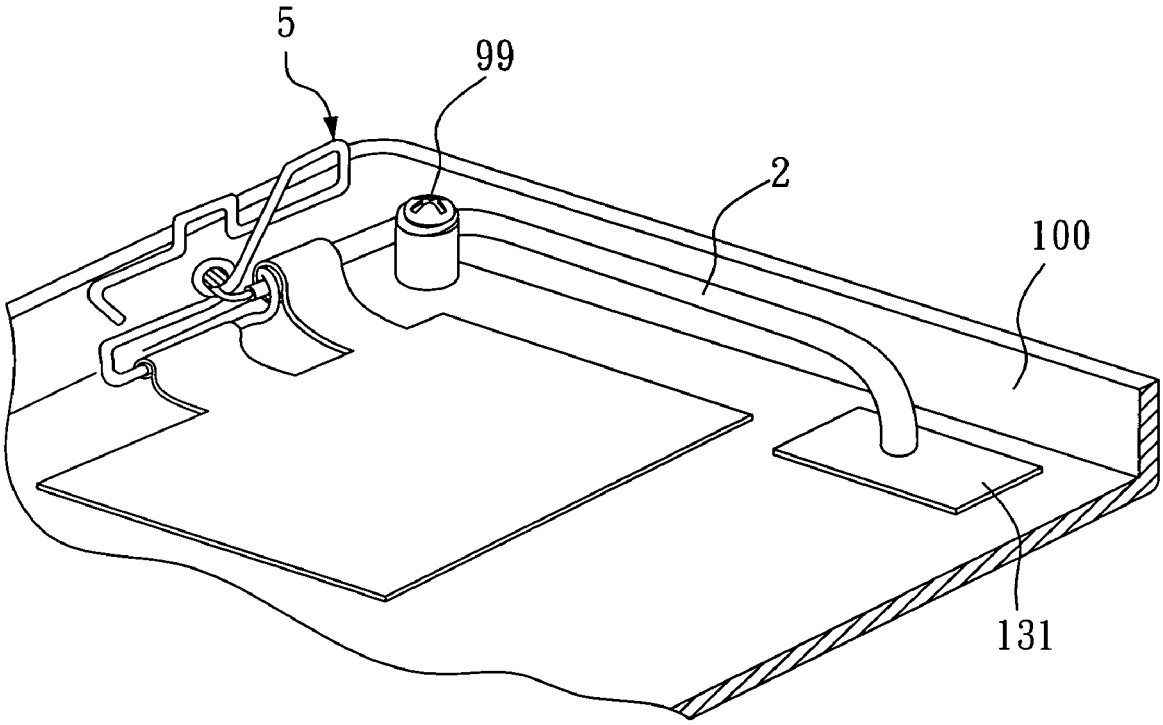
FIG. 13 is a partial perspective view showing antenna connecting with the wireless communication module according to the portable electronic device disclosed in the present invention.
Figure 14:
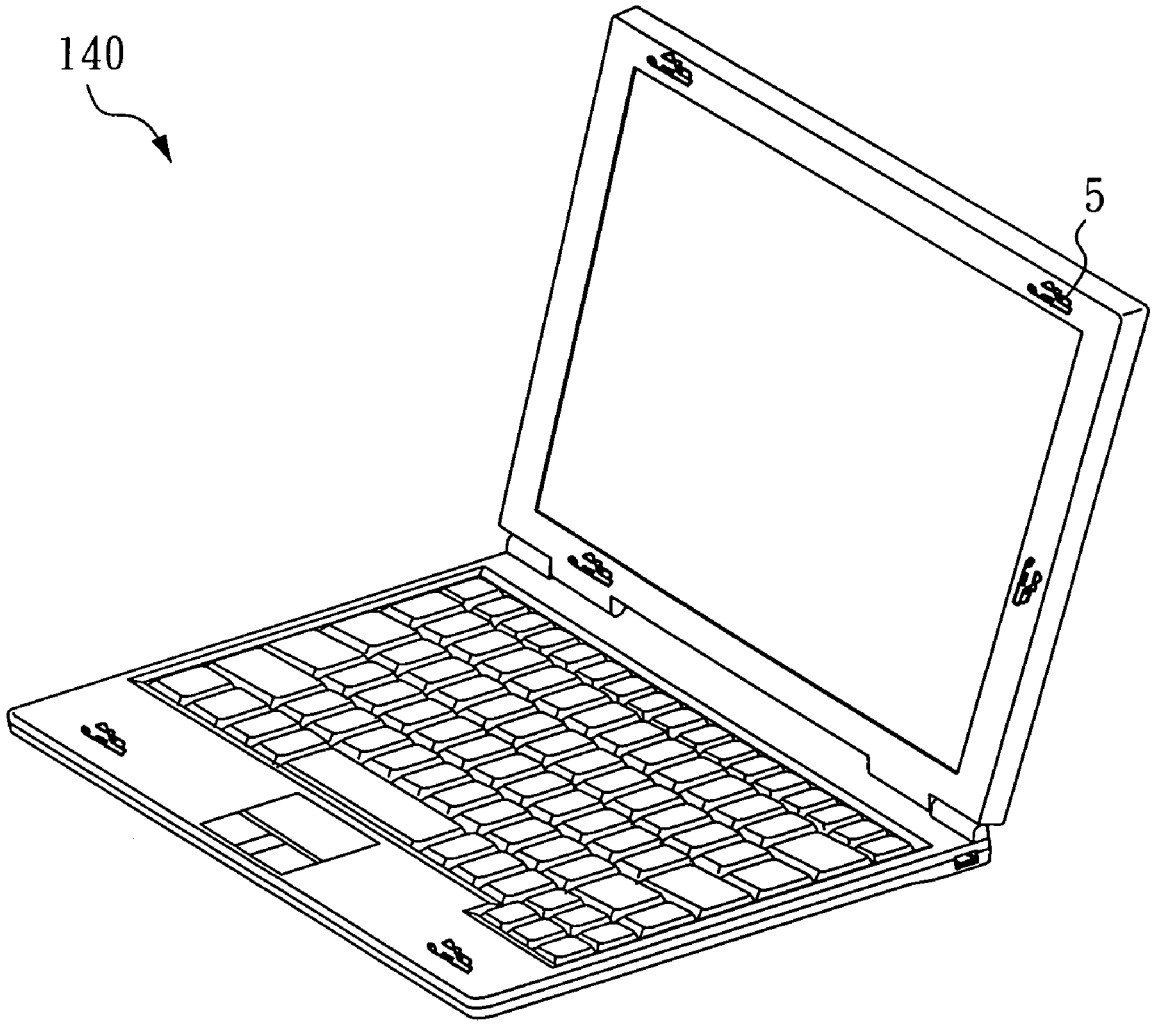
FIG. 14 is a perspective diagram showing different positions for the antenna disposed within the portable electronic device according to the present invention.

Please refer to FIG. 13 and FIG. 14, although a laptop 140 is used as an illustration, it is not intended to limit the present invention, as those skilled in the art will know, the portable electronic device disclosed in the present invention can be a laptop, a personal digital assistant (PDA), or a mobile phone. FIG. 13 partly shows a portable electronic device 140, which comprises a case 100, a wireless communication module 131, and an antenna combination as described above (the antenna 5 is used here as an illustrative example). The antenna 5 electrically connects with the wireless communication module 131 through the coaxial cable 2, wherein the antenna 5 is used to receive and/or transmit wireless signals. Besides, a fixing means 99 can fix the antenna 1 to the case 100 of the portable electronic device 140. For example, a screw is used with the fixing portion 56 of the antenna 5 to fix the antenna 1 to the case 100 of the portable electronic device 140. Furthermore, although the fixing means 99 is a screw in FIG. 13, it is only for illustration example, the fixing means 99 can be in any other formation such as soldering or the like to fix the antenna 5 to the case 100.

As shown in FIG. 14, the antenna 1 or 5 can be disposed at any position in the portable electronic device 140 according to different designs. It should be understood that the figures discussed in the present invention are only for illustration and not for limitation. Various frequencies can be generated through the antenna disclosed in the present invention to cover a wide range of bandwidths for the system requirements. The antenna of the present invention has high practical industrial value as it is simple to design and all the components are formed in one single process, therefore it also leads to low manufacturing cost.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna for transmitting signals through a coaxial cable feeding current, which comprises:

a radiator;

a grounding portion; and an arc-shaped feeding portion coupled with the coaxial cable for feeding current, wherein a first end of the arc-shaped feeding portion is connected with the radiator, and a second end of the arc-shaped feeding portion is connected with the grounding portion.

2. The antenna as claimed in claim 1 further comprising a fixing portion extending from the grounding portion.

3. The antenna as claimed in claim 2, wherein the fixing portion is shaped in circular, round, or polyhedron.

4. The antenna as claimed in claim 1, wherein the radiator comprises a plurality of bending portions.

5. The antenna as claimed in claim 4, wherein the radiator comprises at least one U-shaped portion formed by the plurality of bending portions.

6. The antenna as claimed in claim 1, wherein the grounding portion comprises a helix structure.

7. An antenna combination comprising:

an antenna comprising a radiator, a grounding portion, and an arc-shaped feeding portion, wherein a first end of the arc-shaped feeding portion is connected with the radiator, and a second end of the arc-shaped feeding portion is connected with the grounding portion;

a coaxial cable connecting with the arc-shaped feeding portion of the antenna for feeding current; and a grounding element for covering at least a portion of the grounding portion of the antenna.

8. The antenna combination as claimed in claim 7, wherein the antenna further comprises a fixing portion extending from the grounding portion.

9. The antenna combination as claimed in claim 8, wherein the fixing portion is shaped in circular, round, or polyhedron.

10. The antenna combination as claimed in claim 7, wherein the radiator of the antenna comprises a plurality of bending portions.

11. The antenna combination as claimed in claim 10, wherein the radiator comprises at least one U-shaped portion formed by the plurality of bending portions.

12. The antenna combination as claimed in claim 7, wherein the coaxial cable comprises:

a feeding core;

an isolating layer covering the feeding core and exposing a portion of the feeding core;

a meshed metal layer covering the isolating layer and exposing a portion of the isolating layer; and an insulating sleeve covering the meshed metal layer and exposing a portion of the meshed metal layer, wherein the arc-shaped feeding portion of the antenna is connected with the feeding core for feeding current thereto.

13. The antenna combination as claimed in claim 12, wherein the grounding portion of the antenna comprises a helix structure so as to cover the meshed metal layer of the coaxial cable within the grounding portion.

14. A portable electronic device capable having functions of transmitting wireless signals, which comprises:

a case;

a wireless communication module; and an antenna combination disposed within the case, the antenna combination comprising:

an antenna comprising a radiator, a grounding portion, and an arc-shaped feeding portion, wherein a first end of the arc-shaped feeding portion is connected with the radiator, and a second end of the arc-shaped feeding portion is connected with the grounding portion;

a coaxial cable connecting with the arc-shaped feeding portion of the antenna and the wireless communication module respectively; and a grounding element for covering at least a portion of the grounding portion of the antenna.

15. The portable electronic device as claimed in claim 14, wherein the antenna further comprises a fixing portion extending from the grounding portion, and the fixing portion uses a fixing means to fix the antenna with the case.

16. The portable electronic device as claimed in claim 15, wherein the fixing portion is shaped in circular, round, or polyhedron.

17. The portable electronic device as claimed in claim 14, wherein the radiator of the antenna comprises a plurality of bending portions.

18. The portable electronic device as claimed in claim 17, wherein the radiator comprises at least one U-shaped portion formed by the plurality of bending portions.

19. The portable electronic device as claimed in claim 14, wherein the coaxial cable of the antenna comprises:

a feeding core;

an isolating layer covering the feeding core and exposing a portion of the feeding core;

a meshed metal layer covering the isolating layer and exposing a portion of the isolating layer; and an insulating sleeve covering the meshed metal layer and exposing a portion of the meshed metal layer, wherein the arc-shaped feeding portion of the antenna is connected with the feeding core for feeding current thereto.

20. The portable electronic device as claimed in claim 19, wherein the grounding portion of the antenna comprises a helix structure so as to cover the meshed metal layer of the coaxial cable within the grounding portion.

* * * * *